US006356261B1

(12) United States Patent
Kim

(10) Patent No.: US 6,356,261 B1
(45) Date of Patent: Mar. 12, 2002

(54) METHOD FOR ADDRESSING PLASMA DISPLAY PANEL

(75) Inventor: Sang-chul Kim, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/511,154

(22) Filed: Feb. 23, 2000

(30) Foreign Application Priority Data

Mar. 31, 1999 (KR) ..... 99-11264

(51) Int. Cl.[7] ..... G09G 5/00
(52) U.S. Cl. ..... 345/209; 345/60
(58) Field of Search ..... 345/60, 61, 67, 345/208, 209

(56) References Cited

U.S. PATENT DOCUMENTS 4,044,349 A * 8/1977 Andoh et al. ..... 345/61
6,084,558 A * 7/2000 Setoguchi et al. ..... 345/60
6,232,935 B1 * 5/2001 Fukushima et al. ..... 345/67
6,236,165 B1 * 5/2001 Ishizuka ..... 315/169.1

* cited by examiner

*Primary Examiner*—Kent Chang
(74) *Attorney, Agent, or Firm*—Leydig, Voit, & Mayer, Ltd.

(57) ABSTRACT

A method for addressing a plasma display panel in which scan electrode lines are arranged parallel with one another and address electrode lines are arranged orthogonal to the scan electrode lines, defining corresponding pixels at the respective intersections, the method including grouping the scan electrode lines into at least two scan electrode groups each group having an equal number of scan electrode lines, sequentially applying a preliminary pulse having a first polarity and a scanning pulse having a second polarity, opposite to the first polarity, to the respective scan electrode groups, wherein while the preliminary pulse is applied to a scan electrode line of a first scan electrode group, the scanning pulse is applied to the scan electrode line immediately preceding the scan electrode line of the second scan electrode group corresponding to the scan electrode line of the first scan electrode group, and applying corresponding image data signals to all address electrode lines while the scanning pulse of the second polarity is applied to the respective scan electrode groups.

2 Claims, 3 Drawing Sheets

METHOD FOR ADDRESSING PLASMA DISPLAY PANEL

BACKGROUND OF THE INVENTION

1. Field of the Invention

The present invention relates to a method for addressing a plasma display panel, and, more particularly, to a method adopted for an addressing step in a method for driving a plasma display panel in which a reset step, an address step and a sustain-discharge step are performed in a unit subfield.

2. Description of the Related Art

FIG. 1 shows a general surface-discharge plasma display panel, FIG. 2 is a diagram showing an electrode line pattern of the plasma display panel shown in FIG. 1, and FIG. 3 shows a cell forming a pixel of the plasma display panel shown in FIG. 1. Referring to the drawings, address electrode lines $A_1, A_2, A_3, \ldots, A_{m-1}$ and $A_m$, a dielectric layer 11 (and/or 141 of FIG. 3), scan electrode lines $Y_1, Y_2, \ldots, Y_{n-1}$ and $Y_n$, common electrode lines $X_1, X_2, \ldots, X_{n-1}$ and $X_n$ and a MgO layer 12 as a protective layer are provided between front and rear glass substrates 10 and 13 of a general surface-discharge plasma display panel 1.

The address electrode lines $A_1, A_2, A_3, \ldots, A_{m-2}, A_{m-1}$ and $A_m$, coat the front surface of the rear glass substrate 13 in a predetermined pattern. Phosphors (142 of FIG. 3) may coat over the front surface of the address electrode lines $A_1, A_2, \ldots, A_{m-1}$ and $A_m$. Otherwise, the phosphors 142 may coat the dielectric layer 141 in the event that the dielectric layer 141 coats address electrode lines $A_1, A_2, \ldots, A_{m-1}$ and $A_m$ in a predetermined pattern.

The common electrode lines $X_1, X_2, \ldots, X_{n-1}$ and $X_n$ and the scan electrode lines $Y_1, Y_2, \ldots, Y_{n-1}$ and $Y_n$ are arranged on the rear surface of the front glass substrate 10 orthogonal to the address electrode lines $A_1, A_2, A_3, \ldots, A_{m-2}, A_{m-1}$ and $A_m$ in a predetermined pattern. The respective intersections define corresponding pixels. The common electrode lines $X_1, X_2, \ldots, X_{n-1}$ and $X_n$ and the scan electrode lines $Y_1, Y_2, \ldots, Y_{n-1}$ and $Y_n$ each comprise indium tin oxide (ITO) electrode lines $X_{na}$ and $Y_{na}$, and a metal bus electrode lines $X_{nb}$ and $Y_{nb}$, as shown in FIG. 3. The dielectric layer 11 entirely coats the rear surface of the common electrode lines $X_1, X_2, \ldots, X_{n-1}$ and $X_n$ and the scan electrode lines $Y_1, Y_2, \ldots, Y_{n-1}$ and $Y_n$. The MgO layer 12 to protects the panel 1 against a strong electrical field entirely coats the rear surface of the dielectric layer 11. A gas for forming plasma is hermetically sealed in a discharge space 14.

The driving method generally adopted to the plasma display panel described above is an address/display separation driving method in which a reset step, an address step and a sustain-discharge step are sequentially performed in a unit sub-field. In the address step of the address/display separation driving method, typically, while a scanning pulse is sequentially applied to all scan electrode lines $Y_1, Y_2, \ldots, Y_{n-1}$ and $Y_n$, corresponding image data signals are applied to the address electrode lines $A_1, A_2, A_3, \ldots, A_{m-2}, A_{m-1}$ and $A_m$. However, according to the addressing method using a single pulse, sufficient wall charges cannot be produced at pixels to be displayed, which lowers the accuracy of display.

To solve this problem, there has been disclosed an addressing method in which a preliminary pulse for auxiliary discharge is applied immediately before a scanning pulse is applied. However, in view of driving characteristics of a three-electrode surface-discharge plasma display panel, the preliminary pulse should have a polarity opposite to that of the scanning pulse. Accordingly, while the preliminary pulse is applied to one of the scan electrode lines $Y_1, Y_2, \ldots, Y_{n-1}$ and $Y_n$, if the scanning pulse is applied to another scan electrode line, an undesired discharge is liable to occur at pixels between the corresponding scan electrode lines. According to the auxiliary-charge addressing method, since time for a preliminary pulse to be applied to the respective scan electrode lines $Y_1, Y_2, \ldots, Y_{n-1}$ and $Y_n$ is necessary, the address period in this method is longer than that in the conventional method, which lowers display luminance.

SUMMARY OF THE INVENTION

To solve the above problems, it is an objective of the present invention to provide a method for addressing a plasma display panel, by which both accuracy and luminance of display can be enhanced in driving the plasma display panel.

Accordingly, to achieve the above objective, there is provided a method for addressing a plasma display panel in which scan electrode lines are arranged parallel with one another and address electrode lines are arranged so as to be orthogonal to the scan electrode lines, defining corresponding pixels at the respective intersections, the method including grouping the scan electrode lines into at least two scan electrode groups each having an equal number of scan electrode lines, sequentially applying a preliminary pulse having a first polarity and a scanning pulse having a second polarity opposite to the first polarity to the respective scan electrode groups, wherein while the preliminary pulse is applied to a scan electrode line of a first scan electrode group, the scanning pulse is applied to the scan electrode line immediately preceding the scan electrode line of the second scan electrode group corresponding to the scan electrode line of the first scan electrode group, and applying corresponding image data signals to all address electrode lines while the scanning pulse of the second polarity is applied to the respective scan electrode groups.

According to the addressing method of the present invention, the scan electrode line to which the preliminary pulse is applied and the scan electrode line of the second scan electrode group are spaced a predetermined distance apart from each other, by the partitioning of the scan electrode groups. Accordingly, even if the scanning pulse is applied to the scan electrode line of the second scan electrode group while the preliminary pulse is applied to the scan electrode line of the first scan electrode group, discharge does not occur between the two scan electrode lines.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 4:
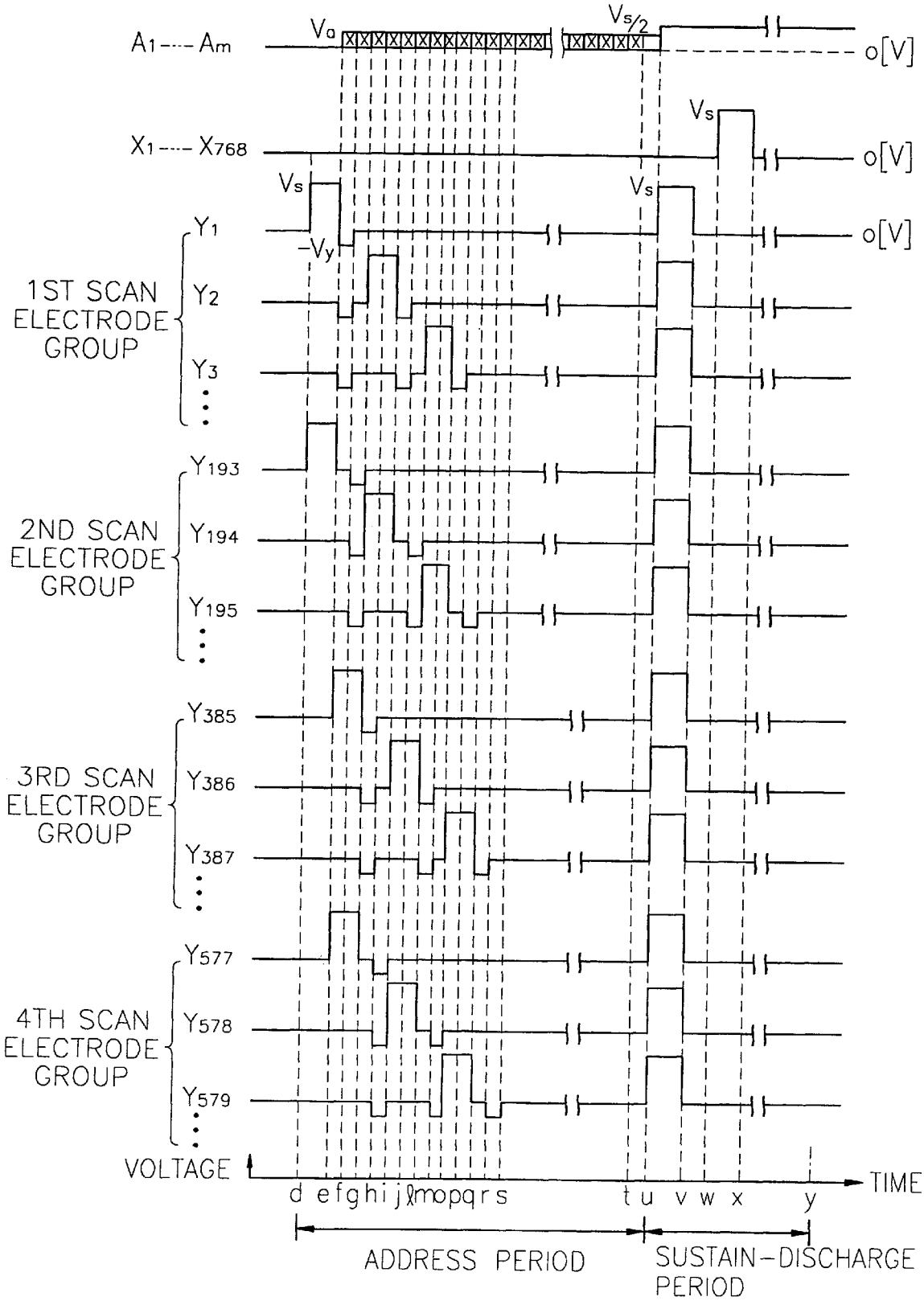
FIG. 4 is a waveform diagram illustrating voltages applied to electrode lines by a method for addressing a plasma display panel according to an embodiment of the present invention.

FIG. 4 shows waveforms of driving voltages applied to a plasma display panel having 768 scan electrode lines $Y_1$, $Y_2, \ldots, Y_{767}$ and $Y_{768}$, according to an embodiment of the present invention. Referring to FIG. 4, the scan electrode lines $Y_1, Y_2, \ldots, Y_{767}$ and $Y_{768}$ are divided into four scan electrode groups each having 192 scan electrode lines. That is to say, a first scan electrode group includes the first scan electrode line $Y_1$ through the 192nd scan electrode $Y_{192}$, a second scan electrode group includes the 193th scan electrode line $Y_{193}$ through the 384th scan electrode $Y_{384}$, a third scan electrode group includes the 385th scan electrode line $Y_{385}$ through the 576th scan electrode $Y_{576}$, and a fourth scan electrode group includes the 577th scan electrode line $Y_{577}$ through the 768th scan electrode $Y_{768}$.

A unit sub-field includes a reset period (not shown), an address period (d-u) and a sustain-discharge period (u-y).

Figure 1:
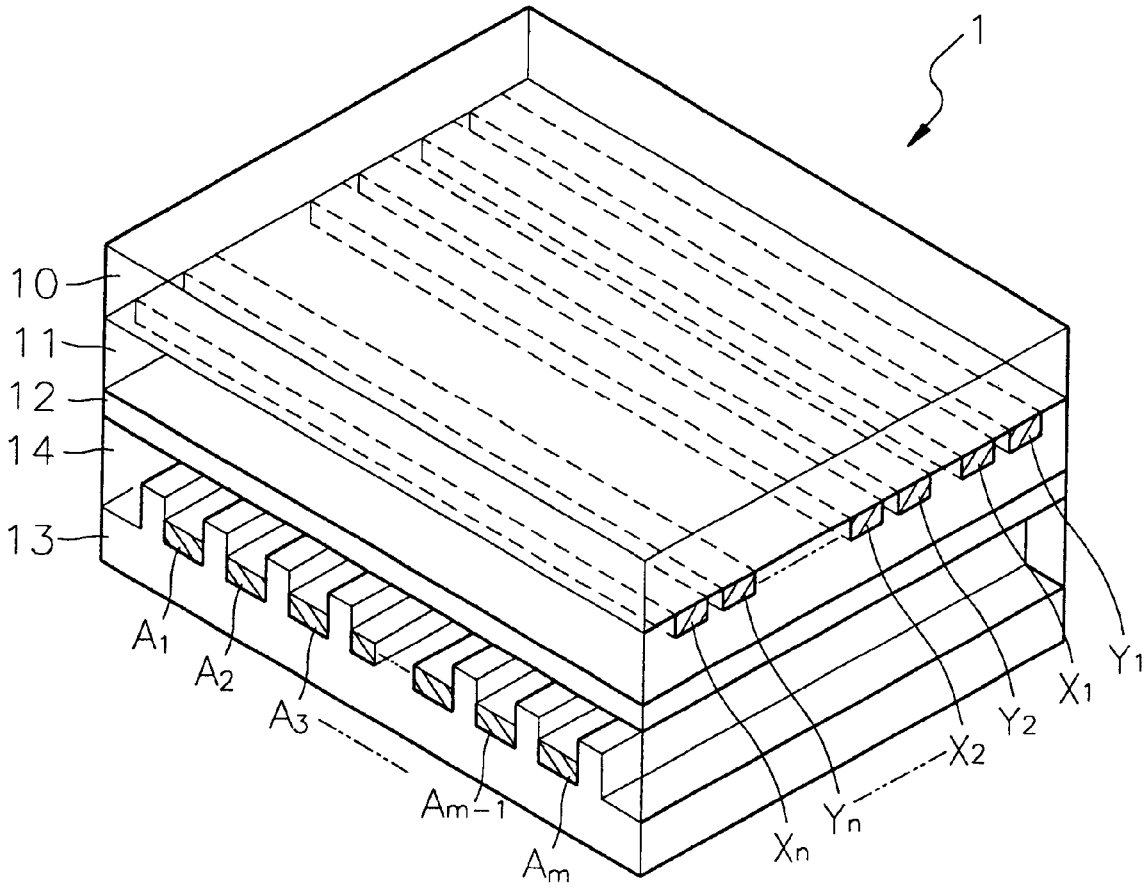
FIG. 1 shows a general surface-discharge plasma display panel.
Figure 2:
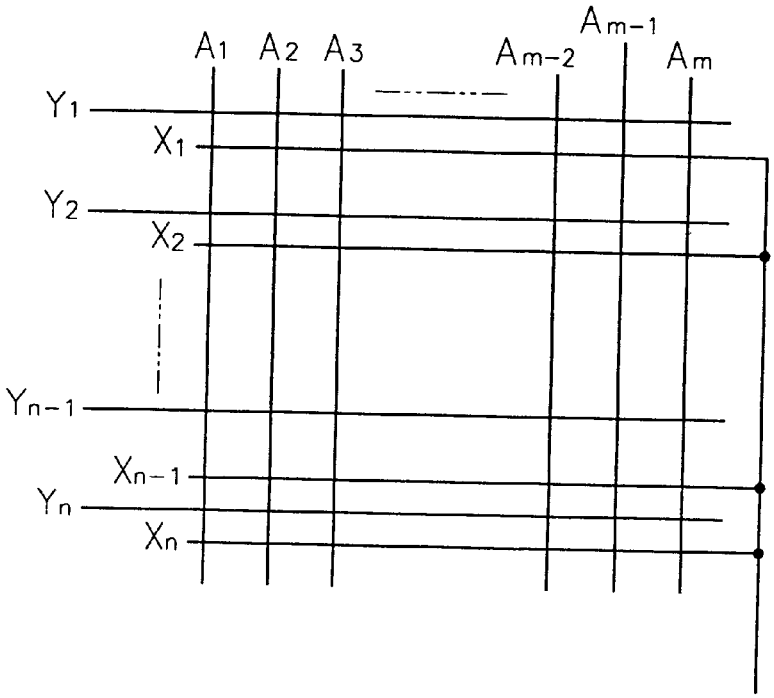
FIG. 2 is a diagram showing an electrode line pattern of the plasma display panel shown in FIG. 1.

In the reset period, wall charges of all pixels are erased and spatial charges are appropriately formed in the discharge space (14 of FIG. 1). The spatial charges are formed for the purpose of increasing accuracy of discharge in the address period (d-u).

The driving method in the address period (d-u) directly related to the present invention will be described.

First, the feature of the present invention lies in that while the scanning pulses are applied to the first and 193rd scan electrode lines $Y_1$ and $Y_{193}$ of the first and second scan electrode groups, respectively, preliminary pulses are applied to the 385th and 577th scan electrode lines $Y_{385}$ and $Y_{577}$ of the third and fourth scan electrode groups, respectively, during a period (e-g). Here, since the first and 193rd scan electrode lines $Y_1$ and $Y_{193}$ are spaced a predetermined distance apart from the 385th and 577th scan electrode lines $Y_{385}$ and $Y_{577}$, interference discharge does not occur in the period (e-g).

Next, while preliminary pulses are applied during a period (g-i) to the second and 194th scan electrode lines $Y_2$ and $Y_{194}$, of the first and second scan electrode groups, respectively, scanning pulses are applied to the 385th and 577th scan electrode lines $Y_{385}$ and $Y_{577}$, of the third and fourth scan electrode groups, respectively. $A_1$,so, since the second and 194th scan electrode lines $Y_2$ and $Y_{194}$ are spaced a predetermined distance apart from the 385th and 577th scan electrode lines $Y_{385}$ and $Y_{577}$, interference discharge does not occur in the period (g-i).

The above-described procedure is repeated for the other scan electrode lines, which can be generalized as follows. That is, assuming that all scan electrode lines $Y_1, Y_2, \ldots, Y_{767}$ and $Y_{768}$ are divided into two scan electrode groups, that is, first and second scan electrode groups, while a preliminary pulse is applied to the nth scan electrode line of the first scan electrode group, e.g., $Y_2$ or $Y_{194}$, a scanning pulse is applied to the (n−1)th scan electrode line of the second scan electrode group, e.g., $Y_{385}$ or $Y_{577}$, in the period (g-h) or (g-i).

The addressing method according to this embodiment will now be described in more detail.

In the first address period (d-e), a preliminary pulse voltage $V_s$ having a positive polarity is applied to the first and 193rd scan electrode lines $Y_1$ and $Y_{193}$, so that spatial charges are produced at the area corresponding to the discharge space (14 of FIG. 1) due to discharge occurring thereat.

In the second address period (e-f), scanning pulses having a voltage $-V_y$ and a negative polarity are applied to the first scan electrode line $Y_1$, and, simultaneously, corresponding image data signals are applied all address electrode lines $A_1, \ldots$, and $A_m$. The duration of the preliminary pulse (d-e) is twice that of the scanning pulse (e-f). If the image data signal is at a logic high level, a pulse of $V_a$ is applied. If the image data signal is at a logic low level, a pulse of 0V is applied. Here, in the discharge space (14 of FIG. 1) between the address electrode lines $A_1, \ldots$, and/or $A_m$ to which the pulse of $V_a$ is applied, and the first scan electrode line $Y_1$, a counter discharge occurs. In the course of a counter discharge subsequently occurring, as described above, at the time (f) when the voltage of the first scan electrode line $Y_1$ is 0 V, the counter discharge is interrupted. Positive (+) wall charges are accumulated on the MgO layer 12 in a selected area of the rear surface of the first scan electrode line $Y_1$. Here, since spatial charges are not produced in the discharge space 14 at the rear surfaces of the other scan electrode lines $Y_2, \ldots$ and $Y_{192}$, in the first address period (d-e), a counter discharge does not occur even if scanning pulses having a voltage $-V_y$ and a negative polarity are applied in the second address period (e-f). Thus, since there is no problem even if scanning pulses of a voltage $-V_y$ having a negative polarity are applied to the other scan electrode lines $Y_2, \ldots$ and $Y_{192}$ of the first scan electrode group in the second address period (e-f), a simplified driving circuit can be attained.

In the third address period (f-g), scanning pulses having a voltage $-V_y$ and a negative polarity are applied to the 193rd scan electrode lines $Y_{193}$, and simultaneously corresponding image data signals are applied to all address electrode lines $A_1, \ldots$, and $A_m$. Here, in the discharge space (14 of FIG. 1) between the address electrode lines $A_1, \ldots$, and/or $A_m$ to which the pulse voltage $V_a$ is applied, and the 193rd scan electrode line $Y_{193}$, a counter discharge occurs. In the course of the counter discharge occurring in such a manner, at the time (g) when the voltage of the 193rd scan electrode line $Y_{193}$ is 0 V, the counter discharge is interrupted. Positive (+) wall charges are accumulated on the MgO layer 12 in a selected area of the rear surface of the 193rd scan electrode line $Y_{193}$. Here, since spatial charges are not produced in the discharge space 14 at the rear surfaces of the other scan electrode lines $Y_{194}, \ldots$ and $Y_{384}$, in the first address period (d-e), a counter discharge does not occur, even if scanning pulses having a voltage $-V_y$ and a negative polarity are applied to the other scan electrode lines $Y_{193}, \ldots$ and $Y_{384}$ of the second scan electrode group in the third address period (f-g). Thus, since there is no problem, even if scanning pulses having a voltage $-V_y$ and a negative polarity are applied to the other scan electrode lines $Y_{193}, \ldots$ and $Y_{384}$ of the second scan electrode group in the third address period (f-g), a simplified driving circuit can be attained.

In the fourth address period (g-u), the addressing method performed in the first, second and third address periods (d-g) is repeatedly applied from the second scan electrode line $Y_2$ through the 192nd scan electrode line $Y_{192}$, and from the 194th scan electrode line $Y_{194}$ through the 384th scan electrode line $Y_{384}$.

In the second and third address periods (e-g), a preliminary pulse voltage $V_S$ having a positive polarity is applied to the 385th and 577th scan electrode lines, so that spatial charges are produced in the area corresponding to the discharge space 14 by discharge.

In the first part of the fourth address period (g-h), scanning pulses having a voltage $-V_y$ and a negative polarity are applied to the 385th scan electrode lines $Y_{385}$, and simultaneously the corresponding image data signals are applied to all address electrode lines $A_1, \ldots$, and $A_m$. Here, in the discharge space (14 of FIG. 1) between the address electrode lines $A_1, \ldots$, and/or $A_m$ to which the pulse of a voltage $V_a$ is applied, and the 385th scan electrode line $Y_{385}$, a counter discharge occurs. In the course of the counter discharge subsequently occurring in such a manner, at the time (h) when the voltage of the 385th scan electrode line $Y_{385}$ is turned to 0 V, the counter discharge is interrupted. Positive (+) wall charges are accumulated on the MgO layer 12 in a selected area of the rear surface of the 385th scan electrode line $Y_{385}$. Here, since spatial charges are not produced in the discharge space 14 in the rear surfaces of the other scan electrode lines $Y_{386}$, . . . and $Y_{576}$, in the second and third address periods (e-g), a counter discharge does not occur, even if scanning pulses having a voltage $-V_y$ and a negative polarity are applied to the other scan electrode lines $Y_{386}$, . . . and $Y_{576}$ of the third scan electrode group in the first part of the fourth address period (g-h). Thus, since there is no problem, even if scanning pulses having a voltage $-V_y$ and a negative polarity are applied to the other scan electrode lines $Y_{386}$, . . . and $Y_{576}$ of the third scan electrode group in the first part of the fourth address period (g-h), a simplified driving circuit can be attained.

In the second part of the fourth address period (h-i), scanning pulses having a voltage $-V_y$ having a negative polarity are applied to the 577th scan electrode lines $Y_{577}$, and, simultaneously, corresponding image data signals are applied all address electrode lines $A_1$, . . . , and $A_m$. Here, in the discharge space (14 of FIG. 1) between the address electrode lines $A_1$, . . . and/or $A_m$ to which the pulse of a voltage $V_a$ is applied, and the 577th scan electrode line $Y_{577}$, a counter discharge occurs. In the course of a counter discharge subsequently occurring in such a manner, at the time (i) when the voltage of the 577th scan electrode line $Y_{577}$ is 0 V, the counter discharge is interrupted. Positive (+) wall charges are accumulated on the MgO layer 12 in a selected area of the rear surface of the 577th scan electrode line $Y_{577}$. Here, since spatial charges are not produced in the discharge space 14 at the rear surfaces of the other scan electrode lines $Y_{578}$, . . . and $Y_{768}$, in the second and third address periods (e-g), a counter discharge does not occur, even if scanning pulses having a voltage $-V_y$ and a negative polarity are applied to the other scan electrode lines $Y_{577}$, . . . and $Y_{768}$ of the fourth scan electrode group in the second part of the fourth address period (h-i). Thus, since there is no problem, even if scanning pulses having a voltage $-V_y$ and a negative polarity are applied to the other scan electrode lines $Y_{577}$, . . . and $Y_{768}$ of the fourth scan electrode group in the second part of the fourth address period (h-i), a simplified driving circuit can be attained.

In the third part of the fourth address period (i-u), the addressing method performed in the second, third, first part of the fourth and second part of the fourth address periods (e-i) is repeatedly applied from the 386th scan electrode line $Y_{386}$ through the 576th scan electrode line $Y_{576}$, and from the 578th scan electrode line $Y_{578}$ through the 768th scan electrode line $Y_{768}$.

In the sustain-discharge period (u-y), a voltage of a half $V_s$, that is, $V_s/2$, is continuously applied to all address electrode lines $A_1$, . . . , and $A_m$ in order to prevent discharge of the address electrode lines $A_3$, . . . , and $A_m$.

Figure 3:
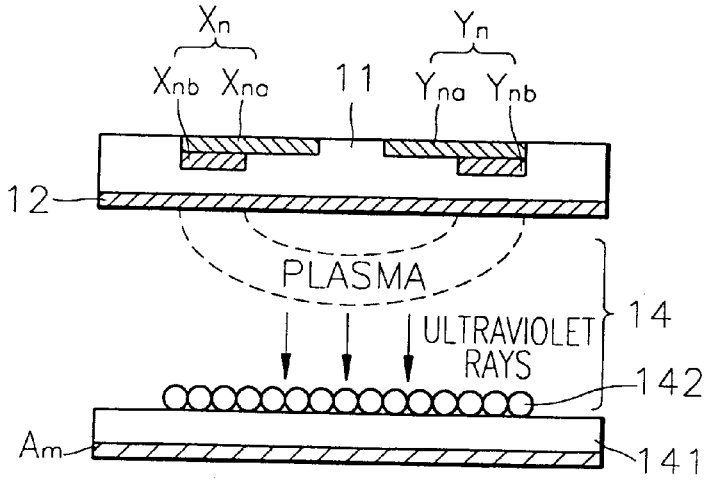
FIG. 3 shows a cell forming a pixel of the plasma display panel shown in FIG. 1.

In the first sustain-discharge period (u-v), 0 V is applied to the common electrode lines $X_1$, . . . , and $X_{768}$, and a pulse voltage $V_s$ for a sustain discharge is applied to all scan electrode lines $Y_1$, . . . , and $Y_{768}$. Accordingly, due to the action of positive (+) wall charges accumulated in the scan electrode line area of selected pixels, a surface discharge occurs between the scan electrodes and common electrodes of the selected pixels. If the surface discharge occurs at the selected pixels in this manner, a plasma is formed in a gas layer of the corresponding area, and phosphors (142 of FIG. 3) are excited by UV irradiation, thereby generating light. Also, negative (−) wall charges are accumulated in the scan electrode area of the selected pixels and positive (+) wall charges are accumulated in the common electrode area thereof.

In the second sustain-discharge period (w-x), a pulse voltage $V_6$ for sustain discharge is applied to the common electrode lines $X_{11}$, . . . , and $X_{768}$, and 0 V is applied to all scan electrode lines $Y_1$, . . . , and $Y_{768}$. Accordingly, due to the action of positive (+) wall charges accumulated in the scan electrode line area of selected pixels, a surface discharge occurs between the scan electrodes and common electrodes of the selected pixels. If the surface discharge occurs at the selected pixels in this manner, plasma is formed in a gas layer of the corresponding area, and phosphors (142 of FIG. 3) are excited by UV irradiation, thereby generating light. $A_1$,so, negative (−) wall charges are accumulated in the scan electrode area of the selected pixels and positive (+) wall charges are accumulated in the common electrode area thereof.

The above-described sustain-discharge periods (u-v) and (w-x) are repeatedly driven until the time (y), that is, until the sustain-discharge period (u-y) set for gray scale display is terminated.

As described above, in the method for addressing a plasma display panel according to the present invention, since the addressing time does not increase even while performing an auxiliary preliminary discharge, both accuracy and luminance of display can be enhanced.

Although the invention has been described with respect to a preferred embodiment, it is not to be so limited as changes and modifications can be made by one skilled in the art within the scope of the invention as defined by the appended claims.

What is claimed is:

1. A method for addressing a plasma display panel in which scan electrode lines are arranged parallel to one another and address electrode lines are arranged orthogonal to the scan electrode lines, defining corresponding pixels at the respective intersections, the method comprising:

grouping the scan electrode lines into at least two scan electrode groups, each group having an equal number of scan electrode lines;

sequentially applying a preliminary pulse having a first polarity and a scanning pulse having a second polarity, opposite to the first polarity, to the respective scan electrode groups, wherein, while the preliminary pulse is applied to a scan electrode line of a first scan electrode group, the scanning pulse is applied to the scan electrode line immediately preceding the scan electrode line of the second scan electrode group corresponding to the scan electrode line of the first scan electrode group; and applying corresponding image data signals to all address electrode lines while the scanning pulse of the second polarity is applied to the respective scan electrode groups.

2. A method for addressing a plasma display panel in which n scan electrode lines are arranged parallel to one another and address electrode lines are arranged orthogonal to the scan electrode lines, defining correspond-ing pixels at the respective intersections, the method comprising the steps of:

(S11) applying a preliminary pulse having a first polar-ity to the first and [(n/4)+1]th scan electrode lines;

(S12) applying a scanning pulse having a second polar-ity, opposite to the first polarity, to the first scan electrode line after the step (S11) is completed;

(S13) applying the scanning pulse having the second polarity to the [(n/4)+1]th scan electrode line after the step (S12) is completed;

(S14) performing the steps S11, S12, and S13 with respect to the second through the (n/4)th scan electrode lines and the [(n/4)+2]through (n/2)th scan electrode lines after the step S13 is completed;

(S21) applying an auxiliary pulse having the first polarity to the [(n/2)+1]th and the [(3n/4)+]th scan electrode lines while the steps S12 and S13 are performed;

(S22) applying the scanning pulse having the second polarity to the [(n/2)+1]th scan electrode line after the step (S21) is completed;

(S23) applying the scanning pulse having the second polarity to the th scan electrode line after the step (S22) is completed;

(S24) performing the steps S21, S22, and S23 with respect to the th through the [(n/2)]th scan electrode lines and the th through nth scan electrode lines after the step S23 is completed; and (S31) applying corresponding image data signals to all address electrode lines while the scanning pulse of the second polarity is applied to the respective scan electrode lines.

* * * * *